United States Patent [19]

Artho et al.

[11] 3,987,801

[45] Oct. 26, 1976

[54] SMOKEABLE PRODUCT WITH MEERSCHAUM PARTICLES AS ABSORBENTS

[75] Inventors: Antoine Artho, Boncourt, Switzerland; Monique Béringer, Saint Louis, France; Paul Buchmann, Basel; Robert Koch, Porrentruy, both of Switzerland

[73] Assignee: Tamag Basel AG, Switzerland

[22] Filed: July 2, 1974

[21] Appl. No.: 485,137

[30] Foreign Application Priority Data

July 24, 1973 Luxemburg ..... 68081

[52] U.S. Cl. ..... 131/17 R

[51] Int. Cl.[2] ..... A24B 3/14

[58] Field of Search ..... 131/2, 15, 17, 140, 131/265, 267

[56] References Cited

UNITED STATES PATENTS

| | | | |
|---|---|---|---|
| 2,734,509 | 2/1956 | Jurgensen | 131/17 AB |
| 3,005,732 | 10/1961 | Specht | 131/17 R |
| 3,106,211 | 10/1963 | Reynolds et al. | 131/17 R |
| 3,428,054 | 2/1969 | Scarabello et al. | 131/265 |
| 3,608,560 | 9/1971 | Briskin et al. | 131/2 |
| 3,744,496 | 7/1973 | McCarty et al. | 131/15 R |
| 3,807,416 | 4/1974 | Hedge et al. | 131/140 C |

FOREIGN PATENTS OR APPLICATIONS

| | | | |
|---|---|---|---|
| 276,194 | 11/1969 | Austria | 131/267 |

*Primary Examiner*—Robert W. Michell
*Assistant Examiner*—J. Millin
*Attorney, Agent, or Firm*—Wenderoth, Lind & Ponack

[57] ABSTRACT

The present invention provides a smokeable product such as cigars, cigarettes, pipe tobacco and the like, having meerschaum particles of 100 $\mu$ diameter as the absorbent and of which at least a part of the tobacco is regenerated tobacco formed of pulp and/or tobacco substitute formed of a pulp. The inventive smokable products exhibit selective absorption of certain injurious smoke components.

3 Claims, 3 Drawing Figures

SMOKEABLE PRODUCT WITH MEERSCHAUM PARTICLES AS ABSORBENTS

Figure 1:
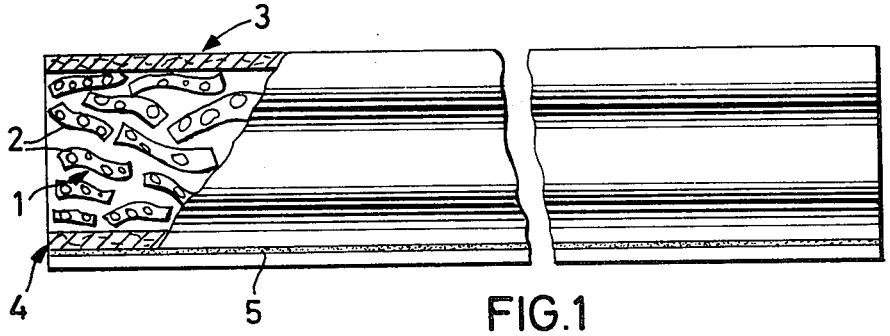

The invention relates to smokable products such as cigars, cigarettes, pipe tobacco and the like having meerschaum particles as adsorbent and of which at least a part of the tobacco is regenerated tobacco formed of a pulp and/or tobacco substitute formed of a pulp. In a regenerated tobacco formed out of the pulp, the latter contains as essential component finely ground natural tobacco, for example, natural tobacco wastes, whereas the pulp intended for tobacco substitute consists mainly of finely ground non-tobacco plants or other substances.

A filter-tipped cigarette is known, the filter of which has a chamber which is filled with a granulate of breccia-like porous magnesium silicate and permeated by the main smoke stream sucked in by the smoker and hence with a noticeable selective action adsorbs the polar smoke components — and these are predominantly injurious to health — but on the other hand permits the predominantly polar non-injurious or less injurious to health aromatic smoke components to pass.

It is an object of the invention to increase this favorable adsorption effect.

The invention is characterised by the feature in that the regenerated tobacco and/or tobacco substitute are permeated with meerschaum particles of 100$\mu$ and smaller in diameter. Whilst in a known cigarette the adsorbing substance could be effective only over a short distance of the filter chamber, the meerschaum particles in accordance with the invention may be effective over the whole distance from the incandescent zone to the mouth end, for example, of the cigarette. Independently thereof the required adsorption of the harmful polar substances is also promoted by the fact that these may come into contact with the meerschaum particles already at the moment in which under the influence of the heat effect of the incandescent zone or that of the main smoke stream passing through. Of note is also the fact that the harmful substances contained in the smoke not drawn in by the smoker but emanating directly from the incandescent zone are at least partly adsorbed by the meerschaum particles contained in the incandescent zone, whereby the health of the passive smokers, hence those who inhale the secondary stream smoke in a closed space, is protected. A corresponding effect is not obtainable with a filtertip, because the latter influences only the main stream smoke.

Meerschaum in question is a magnesium silicate hydrate, which is known as mineral by the name Sepiolith and has a large adsorption area with a strong adsorption affinity for substances having an electric molecular structure, predominantly having smoke components harmful to health. For substances which like most harmless aromatic substances of the smoke are not polar, the adsorption affinity of the meerschaum is considerably lower.

Meerschaum in connection with the invention is also particularly suitable because in contrast to, for example, active carbon, it does not decompose in the incandescent zone giving off harmful gases. The main proportion of adsorbed harmful substances, when the meerschaum particles concerned arrive in the incandescent zone, either remain adsorbed or they are decomposed and thus into decomposition products which are either harmless or are substantially less harmful than the starting products.

The particles preferably consist of breccia-like porous meerschaum. Breccia-like meerschaum is a variety of the non-breccia-like meerschaum and is available cheaply in large quantities. For instance breccia-like porous meerschaum is found in the Madrid tertiary basin. Breccia-like porous meerschaum does not disintegrate in boiling hydrochloric acid 1:1, but at the most is soluble to two thirds therein and during heating to 300° Centrigrade suffers a loss of weight of 15 percent by weight at the most and has a magnesium contents of at least 5 percent by weight — in relation to the dry substance. This breccia-like porous meerschaum cracks non-breccia-like meerschaum due to its greater hardness. The density of breccia-like porous meerschaum, measured at the air-dried section, is approximately 1.2 grammes per cubic centimeter. The density of non-breccia-like meerschaum is, measured under the same conditions, approximately 0.5 – 0.6 grammes per cubic centimeter. Breccia-like porous meerschaum has a surface of at least 100 square meters per gramme. If the meerschaum material is finely powdered and the density determined in the gas pycnometer, then with breccia-like porous meerschaum and with non-breccia-like porous meerschaum the same values, namely 1.8 to 2.0 grammes per cubic centimeter are obtained. Breccia-like porous meerschaum consists of round to angular brownish-white domains which show minor differences in colour and are separated by a white matrix, so that they are already recognizable by the naked eye. At blows with a hammer this stone cracks particularly at the surface of these domains.

Breccia-like porous meerschaum is processed into granulate for cigarette filters. When granulating the granulate is produced mainly from the harder domains while the matrix material lying in between turns to fine dust and is no longer useful as granulate. This material, useless as granulate for structural reasons, has an excellent adsorbing quality with a considerable selective effect in favour of polar harmful substances and as it is furthermore available at low costs as waste from the granulate production it will be employed in accordance with a preferential development of the invention. This development is marked by the fact that the finer waste, resulting from granulating the breccia-like porous meerschaum to a grain size of 0.1 to 5 millimeter diameter, will be used as adsorbing substance and might be ground even finer for this purpose.

Preferably the medial particle diameter of at least three quarters of the meerschaum weight used is as large as half the average value plus/minus 30 percent of the thickness of the regenerated tobacco and/or tobacco substitute which is mixed with these meerschaum particles. The thickness of the tobacco fibres and the tobacco substitute fibres respectively is normally within the order of magnitude of between 100 and 200$\mu$.

If the medial particle diameter is as stated, then the meerschaum particles with which the smouldering parts are mixed does not protract specially, but are nevertheless exposed with a large proportion of their surface, or only covered by a very thin layer through which the harmful substances may easily be diffused.

If the admixing rate, hence the weight ratio of the meerschaum particles mixed to the regenerated tobacco and/or tobacco substitute is increased relative to the weight of the regenerated tobacco and/or tobacco substitute respectively concerned, then also the adsorption rate of the harmful substances is increased, and hence at smaller admixture rates over proportional. The rate of adsorption is the ratio of adsorbed quantity of harmful substance relative to the overall quantity of the harmful substances present. From a certain optimal admixture rate on, the value of which depends upon manifold secondary conditions — quality of the tobacco or the tobacco substitute substances, quality of the meerschaum, method of inserting or addition of the meerschaum and the like — and which may be found by testing in an individual case, the adsorption rate, however, increases only to a small extent. Further increase of the admixture rate of the meerschaum beyond this optimal value is hence not justifiable by the increase of adsorption obtainable therewith alone, it will be necessary to increase it only beyond this optimal value if the property of the meerschaum as filler substance is considered important. If this is not so, then it recommended to retain the maximum admixture rate and a corresponding embodiment of the invention is characterised by the feature that the meerschaum particles are distributed over the regenerated tobacco and/or tobacco substitute with an admixture rate which is so great that a further increase of the admixture rate causes a less than proportional increase of the average adsorption rate of the harmful substances carbon monoxide, Acrolein, Nitrile, Phenol, and the homologous and polycyclic aromatic hydrocarbons thereof, a reduction on the other hand of the admixture rate causes at least reduction proportional thereto of the said average adsorption rate. Preferred are the following admixture rates relative to the dry substance: for regenerated tobacco 14 to 16 percent, for tobacco substitute 20 to 25 percent, and for paper 14 to 20 percent.

A preferred process for producing regenerated tobacco and/or tobacco substitute with embedded meerschaum particles is characterised by the feature that the meerschaum particles are stirred into a pulp prepared for producing regenerated tobacco and/or tobacco substitute before these are formed and set by drying to form smoulderable parts.

A preferred process for producing regenerated tobacco and/or tobacco substitute with added meerschaum particles is characterised by the feature that a pulp prepared for producing regenerated tobacco and/or tobacco substitute is formed to a sheet and dried partly and that the meerschaum particles are scattered and/or rolled onto this still soft sheet so that they are moistened on the surface by the residual moisture of the pulp and that then the sheet is set by finish drying.

The invention will be described in detail by way of the enclosed drawing and some process examples.

Figure 2:
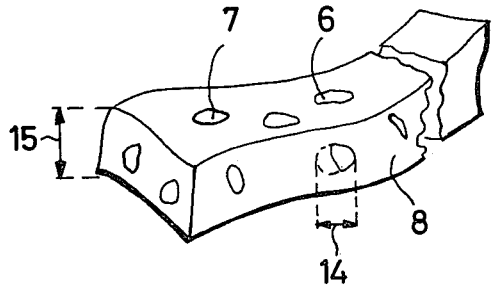
Figure 3:
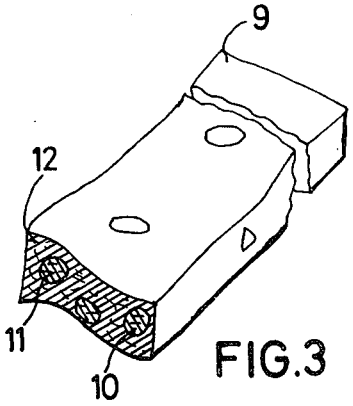

The drawing shows:

FIG. 1 partly in section and seen from the side a cigarette in accordance with the invention, FIG. 2 considerably enlarged relative to FIG. 1 and idealised a tobacco fibre with added meerschaum particles and FIG. 3 also considerably enlarged a tobacco fibre in section with embedded meerschaum particles.

In accordance with FIG. 1 the tobacco filling is denoted by 1 which consists of a fibrous regenerated tobacco. In the individual tobacco fibres 2, as indicated with small circles in FIG. 1, meerschaum particles are embedded. The tobacco filler 1 is enveloped in cigarette paper 3, which is cemented along a longitudinal seam 4, the coating of gum of which is denoted by 5.

In the tobacco fibre shown in FIG. 2 idealised spherically shown meerschaum particles 6, 7 by about half project from the surface of the tobacco fibre 8, whilst with their other half they project into the tobacco fibre where they are retained by a bonding agent which also holds the tobacco fibre together.

In the tobacco fibre 9 shown in FIG. 3, only the cut surface 12 of the embedded meerschaum particles 10, 11 are visible, whilst added meerschaum particles are partially visible.

The two tobacco fibres shown in FIGS. 2 and 3 are of regenerated tobacco, formed of a pulp. Instead it may also concern tobacco substitute or mixtures of regenerated tobacco and tobacco substitute. The filling 1 may also consist of fibres in accordance with FIG. 2 or 3.

The representations in accordance with FIGS. 2 and 3 may also be conceived as representations of cigarette paper sections with added and embedded meerschaum particles respectively.

The meerschaum particles are evenly distributed over the individual tobacco fibres and the cigarette paper respectively and in accordance with FIG. 1 evenly distributed over the whole cigarette.

The particle diameter 14 of at least three quarters of the charged meerschaum weight is as large as half the average value plus/minus 30 percent of the thickness 15 of the regenerated tobacco and/or tobacco substitute which is mixed with these meerschaum particles. The size ratios are accordingly shown in FIGS. 2 and 3. The thickness 15 of a conventional tobacco fibre is about 130$\mu$. When the average diameter of the meerschaum particle is about 45$\mu$ to 85, for instance 50$\mu$, then the surface of these meerschaum particles, as far as they do not protrude from the fibres, in any case to a considerable proportion is closely below the surface of the tobacco fibre and hence easily attainable for the harmful substances diffusing into the tobacco and which then may be deposited on the surface.

EXAMPLE 1

To produce the filler 1, 100 kg of Virginia tobacco wastes of a grain size of maximally 100$\mu$ are suspended in 500 liters of water and forced through a mill having a constantly stirred glass sphere packing, the glass spheres of which have a diameter of about two millimeters, and thereby finely ground to a colloidal grain size. Into the pulp formed there are stirred: 8 kg glycerine, 5 kg sodium-carboxy-methyl cellulose and 80 liters of tap water and 3.5 kg breccia-like porous meerschaum ground to an average diameter of 50$\mu$. The pulp is set on an endless steel belt by drying and by sprinkling with water vapour moistened again to a moisture content of about 10 percent and detached from the steel belt with a scraper. The sheet sections obtained — also called flakes — are cut into tobacco fibres and processed on conventional cigarette machines into cigarettes. The tobacco fibres contain 3 percent meerschaum, related to the dry substance.

EXAMPLE 2

As example 1, with the only difference that in place of 3.5 kg Meerschaum 7.2 kg are added, so that the meerschaum content of the tobacco fibres formed is 6 percent relative to the dry substance.

EXAMPLE 3

As example 1, with the only difference that in place of 3.5 kg meerschaum 11.2 kg are added, so that the meerschaum content of the tobacco fibres formed is 9 percent relative to the dry substance.

EXAMPLE 4

As example 1, with the only difference that in place of 3.5 kg meerschaum 15.4 kg are added, so that meerschaum content of the tobacco fibres formed is 12 percent relative to the dry substance.

EXAMPLE 5

As example 1, with the only difference that instead of 3.5 kg meerschaum 18 kg are added, so that the meerschaum content of the tobacco fibres formed is 14 percent relative to the dry substance.

EXAMPLE 6

As example 1, with the only difference that instead of 3.5 kg meerschaum 19.3 kg are added, so that the meerschaum content of the tobacco fibres formed is 15 percent relative to the dry substance.

EXAMPLE 7

As example 1, with the only difference that instead of 3.5 kg meerschaum 20.6 kg are added, so that the meerschaum content of the tobacco fibres formed is 16 percent relative to the dry substance.

EXAMPLE 8

As example 1, with the only difference that instead of 3.5 kg meerschaum 25.6 kg are added, so that the meerschaum content of the tobacco fibres formed is 20 percent relative to the dry substance.

EXAMPLE 9

For producing the filler 1, 1 kg starting material, comprising a mixture of 700 grammes crushed oats, 200 grammes straw and 100 grammes wheat bran are cut to an approximate grain size of 2 cm and then precomminuted in a hammer mill to 250$\mu$ and finer. The ground material so obtained is suspended in 5 liters of tap water together with 2 grammes of potassium carbonate, 40 grammes molasses, 30 grammes fruit concentrate of peaches and plums, 100 grammes cider press residue, containing approximately 20 percent pectin and 20 grammes hydrolised Soya bean meal. The well stirred suspension is forced through a mill by a constantly stirred glass sphere packing, the glass spheres of which have a diameter of about 3 millimeters, and thereby finely ground to colloidal particle size. Into the finely ground pulp are stirred: 25 grammes sodiumcarboxymethyl cellulose, 70 grammes glycerine, 0.5 grammes carnation powder, 0.5 grammes powdered nutmeg, 25 grammes citric acid and 200 grammes breccia-like porous meerschaum ground to an average diameter of 50$\mu$. The pulp then homogenised by stirring are spread into a sheet and dried with hot air and moistened again on cooling with water vapour set to a moisture content of about 10 percent, related to the dry weight. This sheet has an approximate thickness of 150$\mu$, is elastic and firm and is cut into fibres from which the filler 1 may be formed. The meerschaum content of the tobacco fibres formed is 12 percent relative to the dry substance.

EXAMPLE 10

As example 9, with the only difference that instead of 200 grammes meerschaum 266 grammes are added, so that the meerschaum content of the tobacco substitute fibres formed is 16 percent relative to the dry substance.

EXAMPLE 11

As example 9, with the only difference that instead of 200 grammes meerschaum 332 grammes are added, so that the meerschaum content of the tobacco substitute fibres formed is 20 percent relative to the dry substance.

EXAMPLE 12

As example 9, with the only difference that instead of 200 grammes meerschaum 415 grammes are added, so that the meerschaum content of the tobacco substitute fibres formed is 25 percent relative to the dry substance.

EXAMPLE 13

As example 9, with the only difference that instead of 200 grammes meerschaum 500 grammes are added, so that the meerschaum content of the tobacco substitute fibres formed is 30 percent relative to the dry substance.

EXAMPLE 14

As example 9, with the only difference that 1 kg starting material consists of a mixture of 500 grammes natural tobacco wastes, as accrueing in the cigarette production, 350 grammes crushed oats, 100 grammes straw and 50 grammes oak leaves.

EXAMPLE 15

As example 9, with the only difference that the 100 grammes ground meerschaum are not stirred into the pulp, but are scattered over the drying pulp spread out into a sheet, and only then set by finish-drying.

EXAMPLE 16

As example 14 with the only difference that the 100 grammes ground meerschaum are not stirred into the pulp, but are scattered over the drying pulp spread into a sheet and rolled on, which is only then set by finish-drying.

A very good absorption of harmful substance and a very good consistence are the result of examples 5, 6, 7, 11, and 12. With examples 1, 2, 3, 4, 9, 10, 14, 15, and 16 the consistence is very good, the absorption of harmful substance, however, slightly less then with examples 5, 6, 7, 11, and 12, but it is still sufficient for many applications. With examples 8 and 13 the consistence is imperfect and the absorption of harmful substance only slightly better than with example 5, 6, 7, 11, and 12. Except for examples 8 and 13 all examples are suitable for practical application.

The regenerated tobacco or tobacco substitute produced by way of these examples may be used alone or mixed with natural tobacco.

We claim:

1. In a smokable product having meerschaum particles as an adsorbent and of which at least a part of the tobacco is regenerated tobacco formed of a natural or artificial tobacco pulp, the improvement which comprises employing meerschaum particles having a diameter of 100 microns and less in admixture with said regenerated or artificial tobacco, said meerschaum particles consisting of breccia-like porous meerschaum, which does not disintegrate in boiling nitric acid 1:1, but is soluble therein at the most ⅔ and which during heating to 300° C has a weight loss of at most 15% by weight and which has a magnesium content of at least 5% by weight based on the dry substance, which breccia-like porous meerschaum on account of its greater hardness, scratches the non-breccia-like meerschaum and the density thereof measured at the air-dried section is about 1.2 grams per cubic centimeter compared with the non-breccia-like meerschaum, the density of which measured under the same conditions, is about between 0.5 and 0.6 grams per cubic centimeter and which breccia-like porous meerschaum has a surface of at least 100 square meters per gram, said breccia-like porous meerschaum consisting essentially of the fine waste which results from granulating breccia-like porous meerschaum to obtain grains of 0.1 to 5 millimeters diameter, said breccia-like porous meerschaum being evenly distributed throughout said smokable product in an effective amount to selectively adsorb polar harmful substances in tobacco smoke.

2. A product according to claim 1 wherein the medial particle diameter of at least three quarters of the meerschaum weight used is as large as half the average value plus/minus 30 percent of the thickness of the regenerated tobacco and/or tobacco substitute which is mixed with these meerschaum particles.

3. A product according to claim 1 wherein the meerschaum particles are distributed throughout the regenerated tobacco and/or artificial tobacco in an amount such that a further increase causes a less than proportional increase of the average adsorption rate of the harmful substances carbon monoxide, acrolein, nitriles, phenol, and their homologs, and polycyclic aromatic hydrocarbons, and on the other hand, a reduction of the amount causes at least a reduction proportional thereto of the said average absorption rate.

* * * * *